US009902529B2

(12) United States Patent
Reinders

(10) Patent No.: US 9,902,529 B2
(45) **Date of Patent: *Feb. 27, 2018**

(54) CONTROLLING ACCESS TO A STRUCTURE WHICH IS OPENED AND CLOSED USING A PLASTIC ZIPPER

(71) Applicant: Robert C. Reinders, Las Vegas, NV (US)

(72) Inventor: Robert C. Reinders, Las Vegas, NV (US)

(73) Assignee: Robert C. Reinders, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/732,190

(22) Filed: Jun. 5, 2015

(65) Prior Publication Data

US 2016/0255919 A1 Sep. 8, 2016

Related U.S. Application Data

(60) Provisional application No. 62/128,719, filed on Mar. 5, 2015.

(51) Int. Cl.
*B65D 33/16* (2006.01)
*B65D 33/25* (2006.01)
(Continued)

(52) U.S. Cl.
CPC ..... *B65D 33/2591* (2013.01); *A44B 19/26* (2013.01); *A44B 19/305* (2013.01); *A44B 19/303* (2013.01); *B65D 2215/04* (2013.01)

(58) Field of Classification Search
CPC ... B65D 33/2591; A44B 19/267; A44B 19/30; A44B 19/301; A44B 19/303; A44B 19/305; A44B 19/306; A44B 19/308
(Continued)

(56) References Cited

U.S. PATENT DOCUMENTS 2,826,797 A * 3/1958 Reeves ..... A44B 19/301 24/387
3,754,306 A 8/1973 Cirone
(Continued)

FOREIGN PATENT DOCUMENTS

CN 101820790 B 5/2012
KR 709620 B1 4/2007
(Continued)

OTHER PUBLICATIONS

PACTECH, PACTECH Flexible. Capable. Reliable., 1994, 5 pages, PacTech Packaging, Rochester, NY.
(Continued)

*Primary Examiner* — Jes F Pascua
(74) *Attorney, Agent, or Firm* — Thomas D. Wilhelm; Northwind IP Law, S.C.

(57) ABSTRACT

Access-limiting mechanism limits access to a container. Access is controlled by moving a slider back and forth along a plastic zipper, opening and closing the zipper. The access-limiting mechanism includes, in addition to the slider, a coupler. The coupler can stay fixed, immovable, at a given location, relative to the zipper; or can be moved along the length of the zipper. As the slider moves close to the coupler, the slider and coupler are coupled to each other, limiting the ability of the slider to open the zipper. Access can be further limited by adding a second control mechanism such as a cover which overlies, optionally latches to, one or both of the slider and the coupler. To open the container, the slider and coupler, and/or as applies the cover, are released from respective coupling arrangements. Then, the slider can be moved away from the coupler to open the container.

30 Claims, 8 Drawing Sheets

(51) Int. Cl.
*A44B 19/26* (2006.01)
*A44B 19/30* (2006.01)

(58) Field of Classification Search
USPC ..... 383/64; 24/399, 400, 585.12
See application file for complete search history.

(56) References Cited

U.S. PATENT DOCUMENTS 4,031,724 A 6/1977 Atkinson
4,350,375 A * 9/1982 Bako ..... A44B 19/301 24/386
4,514,884 A * 5/1985 Kaneko ..... A44B 19/301 190/120
4,807,300 A 2/1989 Ausnit et al.
4,930,323 A * 6/1990 Terada ..... A44B 19/301 70/68
4,976,120 A * 12/1990 Terada ..... A44B 19/301 70/312
5,063,760 A * 11/1991 Horita ..... A44B 19/301 70/23
5,103,657 A * 4/1992 Horita ..... A44B 19/301 70/312
5,681,115 A * 10/1997 Diederich ..... A44B 19/301 190/120
5,896,628 A 4/1999 Oda
6,062,051 A * 5/2000 Nam ..... A44B 19/301 70/312
6,385,818 B1 * 5/2002 Savicki, Sr. ..... B65D 33/2591 24/30.5 R
6,427,421 B1 8/2002 Belmont et al.
6,431,754 B1 * 8/2002 Savicki, Sr. ..... A44B 19/267 156/73.1
6,510,593 B1 * 1/2003 Kim ..... A44B 19/301 24/382
6,524,002 B2 2/2003 Tomic
6,533,335 B2 * 3/2003 Hudson ..... A44B 19/301 190/903
6,701,584 B2 3/2004 Metzger
7,073,233 B2 * 7/2006 Leva ..... A44B 19/26 24/386
D526,931 S * 8/2006 Koenig ..... D11/221
7,311,443 B2 12/2007 Buchman
7,404,240 B2 * 7/2008 Nedbal ..... A44B 19/262 24/415
7,506,417 B2 * 3/2009 Yoneoka ..... A44B 19/301 24/386
7,533,451 B2 * 5/2009 Akashi ..... A44B 19/301 24/386
7,581,420 B2 9/2009 Manthe et al.
7,849,543 B2 12/2010 Poston, Jr. et al.
8,893,356 B2 * 11/2014 Ozaki ..... B65D 33/2591 24/415
9,375,059 B2 * 6/2016 Jin ..... A44B 19/303
9,456,663 B1 * 10/2016 Wheeler ..... A44B 19/301
2003/0014848 A1 * 1/2003 LaRue ..... A44B 19/267 24/387
2007/0044280 A1 3/2007 Chang
2011/0126384 A1 6/2011 Ozaki et al.
2012/0311785 A1 * 12/2012 Goldberg ..... A47C 31/007 5/498
2014/0311101 A1 * 10/2014 Petkovsek ..... B65D 33/2591 53/480
2014/0311102 A1 * 10/2014 Petkovsek ..... B65D 33/2591 53/481
2016/0001930 A1 * 1/2016 Kirsh ..... B65D 33/34 24/30.5 L

FOREIGN PATENT DOCUMENTS

WO 0067605 11/2000
WO 0203824 1/2002
WO 2014150576 9/2014

OTHER PUBLICATIONS

First child-resistant slider for flexpacks launched, Nov. 2, 2014, 2 pages, Rick Lingle.
Presto launches CHILD-GUARD, First Ever Child-Resistant Slide for Flex Packaging, Nov. 2, 2014, 2 pages Christina Wilcox.

* cited by examiner

CONTROLLING ACCESS TO A STRUCTURE WHICH IS OPENED AND CLOSED USING A PLASTIC ZIPPER

CROSS-REFERENCE TO RELATED APPLICATION

This application is a Non-Provisional application which claims priority under 23 U.S.C. § 120 to Provisional application Ser. No. 62/128,719, filed Mar. 5, 2015, which is incorporated herein by reference in its entirety.

BACKGROUND

This invention pertains to zippers, and especially to plastic zippers which are used to control access, to open and close, e.g. plastic bags or other packaging structures, thus temporarily closing off access, and also allowing access, as appropriate, to the contents of the package. Access to contents of the bag is prevented when the zipper is closed, and access to contents of the bag is enabled when the zipper is open.

In a broad sense, the invention can pertain to any use of slider-based plastic zippers which control access to contents of a package or other container, or other controlled-access space.

In some instances, the zipper elements may be disposed inside a closed compartment of the container/bag/package, and a second closure/seal, intended to be a single-use closure/seal, is used in addition to the re-closable, re-openable closure/seal affected by the zipper, thus closing in the entirety of the zipper within the space enclosed inside the bag. In such structure, once the single-use seal/closure has been breached, opened, e.g. by the consumer of the bag contents, thus exposing the zipper, the re-closable zipper is subsequently used to provide temporary and re-closable access, namely intermittent access, to the contents of the container/package/bag while otherwise sealing the container/package/bag, for example to preserve freshness and/or quality of the product contained within the container/package/bag.

In early commercial versions of plastic bags which have zippers, which early versions are still commercially available, the zipper is defined by first and second facing interlocking rails on facing or overlapping panels of the plastic bag e.g. while the bag is being fabricated. Such interlocking rails are in facing relationship with each other, typically at the top of the bag. Typically, such interlocking rails extend the full respective dimension, for example the width or the length, of the bag. The user presses and holds the interlocking rails against each other, and advances that held pressure along the length of the interlocking rails, namely across the width, or the length, of the bag, whereby the interlocking rails are pressed into a lacking engagement with each other along the length of the zipper, thus to seal closed the facing interlocking rails of the zipper at the facing panels.

Such plastic zippers have now come into commercial use in combination with a variety of products which are packaged in flexible plastic packaging, for example various types of food, whether sold through grocery stores or convenience stores or as ready-to-eat products/food sold through e.g. a restaurant, a café, or the like.

One of the challenges accompanying such early versions of plastic zippers on plastic bags is/was the need to apply the necessary amount of pressure to the pair of interlocking rails, progressively along the entirety of the full length of the zipper in order to affect closure of the zipper along the full length of the zipper. If the user does not apply the necessary level of pressure at all points along the length of the interlocking rails, some portion of the length of the zipper can be left open, unsealed, whereby the contents of the bag are not protected from leakage out of the bag, or from infiltration of unwanted materials into the bag, or from infiltration of ambient conditions into the bag, which may adversely affect the contents of the bag. Similarly, if the interlocking rails are not properly laterally aligned with each other, no amount of pressure will provide the desired closure/seal which is the purpose of having a plastic zipper.

So there are some challenges associated with using, attempting to use, zippers where achieving a sealed closure of the zipper relies on the user being able to properly align the interlocking rails, and to apply a sufficient amount of pressure along the full lengths of such properly aligned interlocking rails of the zipper.

In a later, and known, commercially-available version of such plastic bags which can be "zipped" closed, a "slider", as a second and distinct element, not part of the container/bag, itself, is mounted to, and straddles, the two sides of the bag at facing interlocking rails. As the user pulls the slider along the interlocking rails in a first direction, the slider engages both of the interlocking rails, performing the tasks of keeping the interlocking rails properly aligned with each other, and applying the appropriate interface and/or pressure between the facing interlocking rails, progressively along the length of the zipper as the slider is moved along the length of the zipper, whereby the facing interlocking rails are progressively sealed closed against each other, thus progressively sealing the bag closed at the zipper as the slider progresses along the length of the zipper. Such closure/seal prevents access to the contents of the bag so long as the zipper remains closed/sealed, as well as preventing spillage or leakage of the contents from the bag.

So a plastic zipper which uses a slider is both easier to operate, and more reliable in actually closing the full length of the zipper, than a zipper which relies on the user for interlocking rail alignment and for applying the proper amount of pressure along the full length of the zipper.

But the ease of closing the bag applies equally well to ease of opening the bag at the zipper, thus unsealing and opening the bag, by pulling the slider in the opposing direction, whereby the slider releases, re-opens the closure/seal and the bag is opened at the zipper, allowing access to the contents of the bag. Thus, just as with the non-slider version of plastic zippers, slider-based plastic zippers provide the ability to seal the bag closed, then re-open/unseal the bag. Such bag can be sealed, and re-opened, a plurality of times using a single slider on such plastic zipper.

Whether the zipper consists only of the facing interlocking rails, or includes a slider as a separate element, either way, the process of opening the zipper and accessing the contents of the bag is easy enough that a child, or other unauthorized individual, has the ability and/or strength to open the bag and access the contents of the bag.

While the original such type of locking bags, without separate slider element, is still available, and less expensive than bags which use the separate slider, bags with a separate slider seem to be easier to use. And slider bags provide greater assurance of in fact achieving a full seal along the full length of the zipper. Depending at least in part on strength and dexterity of the user, and diligence of the user of a bag where a slider is not used, slider bags may provide greater assurance that the zipper is in fact fully closed and sealed along a continuous and full length of the zipper. Especially where the cost of the bag is trivial relative to the cost of the contemplated/expected contents of the bag, bags having the slider may be more commonly used in the commercial market than zipper bags which do not employ a plastic zipper.

As more and more types of products are being packaged in bags having closures which use a slider on a plastic zipper, there arises the challenge of how to keep the bag sealed closed, while also enabling opening of the bag for access to the bag contents by an authorized user. For example, where a hazardous or toxic product, such as, for example and without limitation, dish soap or laundry soap, or a marijuana product, or a pesticide product, or a fungicidal product, or a fertilizer product, is packaged and/or sold in such a bag, there is a need to prevent unauthorized individuals, such as a child, from accessing the hazardous or toxic product, or controlled substance.

In bags which do not use a slider, the e.g. child simply tugs, pulls on the walls of the closed/sealed bag enough that, if the child is strong enough, the child eventually gets the bag open and thus has access to such hazardous contents.

Where a slider is used, gaining access to bag contents is even easier because the slider is easier to use. All the e.g. child has to do is to apply a pull force to the slider, and continue pulling until the child gets the pull force going in the right direction to move the slider, thus to open the bag.

Thus, while a bag which does not use a slider poses a less-than-desirable barrier to a child, the typical slider poses even less of a barrier to a child's ability to access the product inside the bag. And yet it is the slider-type re-openable closure mechanism which provides the easiest access to the bag contents for an authorized user, as well as the greatest assurance that the bag has, in fact, been fully closed/sealed at the zipper.

In some embodiments, a slider-based zipper can be used on facing flexible plastic panels where the flexible plastic panels are mounted to one or more other elements of the package/container structure which are generally considered to be inflexible, for example such facing flexible plastic panels may be mounted to hard plastic, plastic or other flexible laminate, or cardboard, or corrugated board, or natural or manufactured wood products, or metal portions of a container/package, optionally functioning as flexible extensions of such elements. Such embodiments encounter the same challenges as mentioned above, relating to interlocking rail alignment, closing pressure, and preventing unauthorized access to the product contained in such package/container.

Thus it would be desirable to provide a way to limit access to the product-holding compartment of a package or other structure which is opened and closed by a plastic zipper.

It would further be desirable to provide an access-controlling mechanism, for example and without limitation, a locking mechanism, for use at the zipper on a plastic bag.

It would also be desirable to provide such access-controlling mechanism as a locking mechanism for use on a container/receptacle/package/bag which uses a plastic zipper with a slider to close, and to then re-open, such container, at will, in order to deny unauthorized access to the contents of the container such as to a child or other physically or mentally or otherwise developmentally-challenged/disabled individual, while also allowing, enabling ready access to authorized individuals.

Such mechanism should desirably make it difficult, preferably impossible, for a child or other physically or mentally-challenged user to open the bag or other container, thus to gain access to the contents of the bag, through the zipper, while allowing access to an authorized user.

SUMMARY

This invention provides an access-controlling, access-limiting, mechanism, namely an access-limiting structure, for limiting access to a container, a package, a bag, or other receptacle or space through an opening which is closed, and re-opened, optionally controlling access, at multiple times each direction, by a plastic zipper where the zipper is opened and closed by use of a slider. Access is controlled by moving a slider back and forth along a plastic zipper, opening and closing the container. The access-limiting mechanism includes, in addition to the slider, a coupler. The coupler can stay fixed, immovable, at a given location, relative to the zipper; or can be moved along the length of the zipper. As the slider moves close to the coupler, the slider and coupler are coupled to each other, limiting the ability of the slider to open the zipper. Access is further limited by adding a second control mechanism such as a cover, optionally a latching cover, which overlies one or both of the slider and the coupler. To open the container, the slider and coupler and, as applies, the cover, are released from respective coupling arrangements, whereupon the slider and coupler can be moved away from each other thereby opening some or all of the length of the zipper, and correspondingly opening the container to the extent the zipper has been opened.

Sliding the slider in a first direction closes the zipper opening. Sliding the slider in the opposite direction opens the zipper opening. The invention provides an obstruction device, such as a lock, which impedes, optionally prevents, unauthorized individuals from sliding the slider away from the coupler to thus open the container and access the contents of the container.

For example and without limitation, the invention provides, as a first access-controlling, access-limiting mechanism, a lock structure which locks the slider to the coupler, the coupler being mounted on a substrate, such as a plastic bag, on which the slider is operative.

The first piece of the first access-limiting structure is the slider, itself, which has several of the same features as a conventional slider on a slider-based plastic zipper. The user moves the slider back and forth along the length of the zipper, thereby opening and closing the zipper as the slider is moved, and thereby opening and closing the e.g. plastic bag in accord with a given position of the slider along the length of the zipper.

The second piece of the first access-limiting structure is the coupler which, in some embodiments, stays fixed, immovable, at a given location, relative to the zipper e.g. at one side of the bag and, in some embodiments, straddles the elongate interlocking rails which extend along the length of the zipper. The slider is slid back and forth on the interlocking rails along the length of the zipper, opening or closing the zipper as the slider moves each direction and correspondingly opening or closing access to the contents which may be inside such container/package/bag, depending on which direction the slider is being moved.

While the slider provides access, or not, to the bag through the zipper, the invention limits, and in some embodiments, completely controls, a potential user's ability to slide the slider. Namely, the slider and/or coupler collectively have cooperating access-controlling, at least access-limiting, elements, e.g. male and female locking elements, which provide a locking function, or other access-limiting function, for example some obstruction, which functions to limit/control a potential user's ability to move/slide the slider and coupler away from each other.

Access may be controlled/limited by cooperating elements on the slider and coupler, which can be locked to each other. Access is further controlled by an obstructing or otherwise limiting element which obstructs access to a users ability to slide the slider away from the coupler. Access is controlled by a combination of locking elements and the obstructing element. Access may be controlled by multiple locks such that more than one access-limiting element/lock must be released in order to move/slide the slider and coupler away from each other. The number of access-limiting barriers, and the level of sophistication of the access-limiting barriers are designed and configured to deny, or at least limit, access to the types of unauthorized individuals who are most capable of circumventing access-limiting barriers. Typically, less capable unauthorized individuals will inherently be unable to circumvent such access-limiting barriers/elements.

When the slider and coupler are locked to each other, the slider cannot be freely slid along the length of the zipper and away from the coupler to thereby open the zipper, whereby primary access to opening of the bag, and corresponding accessing of the contents of the bag, is prevented. Rather, first the lock must be released/unlocked/de-coupled; and subsequently the slider and coupler can be slid away from each other, along the length of the zipper to open the bag.

In some embodiments, the male locking element is on the coupler and the female locking receptacle is on the slider.

The cover is mounted on one of the slider and the coupler, or optionally on another one of the package elements, such as a wall of the package. The cover can be used to cover the slider, thus obstructing access to the slider; or can be used to cover the release elements, thus to limit access to the release elements which are used to release the slider and the coupler from each other. In order to slide the slider along the length of the zipper away from the coupler, thus to gain access to the contents of the bag, the cover must first be unlatched, and moved from its covering position; and then the slider can be slid along the length of the zipper away from the coupler thereby to open the zipper, thus to open the container.

The second locking mechanism provides a second locking/latching function whereby the slider and the coupler are locked to each other by both first and second locks latches. In order to slide the slider, both the first and second locking mechanisms must first be released, whereupon the slider can be slid along the zipper and away from the coupler thereby to open the zipper.

In some embodiments, the second locking mechanism also covers and/or obstructs access to one or more lock release elements of the first locking mechanism whereby the second locking mechanism acts both as a lock and as an obstruction or cover; which forces a specific sequence of events wherein the second locking mechanism must be released in order for an individual to have access to the first locking mechanism. In such instance, a thwarted attempt to open the second locking mechanism automatically acts to prevent the opening of the first locking mechanism, even if the individual has the know how and physical ability to open the first locking mechanism.

In a first family of embodiments, the invention comprehends apparatus for limiting access to a compartment of a package through a plastic zipper when mounted on the package, the apparatus comprising a slider, having a slider body, the slider body comprising a slider channel adapted to interface with first and second interlocking rails on the package, the slider body being adapted to being moved back and forth along lengths of the interlocking rails whereby interaction between the slider channel and the interlocking rails opens and closes the zipper; a coupler, having a coupler body, the coupler being adapted to being attached to the package; a restraining mechanism as part of one of the slider body and the coupler body, the restraining mechanism being designed and configured to engage structure on the other of the slider body and the coupler body, thereby to couple the slider and the coupler to each other; release structure adapted and configured to be activated by a user so as to disengage the slider body and the coupler body from each other; and a cover attached, at a first location on the cover, to one of the slider and the coupler, the cover being adapted to being in a covering relationship over the release structure when the slider and the coupler are coupled to each other.

In some embodiments, the cover is adapted to being in an overlying relationship over at least one of the slider body and the coupler body when the slider and the coupler are coupled to each other.

In some embodiments, the cover comprises an interference structure which is adapted and configured to engage the release structure so as to interfere with activation of the release structure when the interference structure is so engaged with the release structure.

In some embodiments, the interference structure further comprises a second restraining mechanism by which the cover is releasably coupled to the one of the slider and the coupler to which the cover is not attached, at a second location on the cover.

In some embodiments, the cover is adapted to overlie at least a portion of the release structure so as to interfere with a user activating the release structure and the user thereby releasing the slider and the coupler from each other.

In some embodiments, the cover is adapted to being moved into an overlying relationship with at least a portion of the release structure so as to interfere with a user activating the release structure and thereby releasing the slider and the coupler from each other.

In some embodiments, the cover is attached to the one of the slider and the coupler by a hinge wherein a width, optionally an entirety of a width, of the hinge is resiliently flexed when the cover is moved from a rest position, which rest position is accompanied by either no flexural stress or a relatively lower flexural stress condition in the hinge, to a position overlying and covering the release structure, which overlying and covering position is accompanied by a relatively greater flexural stress condition in the hinge, and thus a bias toward movement of the cover away from the covering relationship to a position accompanied by less stress in the hinge.

In some embodiments, the cover is attached to the one of the slider and the coupler by a living hinge and wherein, when the slider and the coupler are engaged with each other, and when the living hinge is in a rest condition, the cover extends, from the hinge, away from the other of the slider and the coupler.

In some embodiments, the cover is brought into the covering relationship over the release structure by rotating the cover about the hinge.

In some embodiments, the restraining mechanism comprises a male element on one of the slider and the coupler, and a female receptacle on the other of the slider and the coupler.

In some embodiments, the release structure comprises first and second release fingers on the one of the slider and the coupler which is associated with the female receptacle, and wherein the release fingers engage and deflect the male element in affecting the slider and the coupler being released from each other.

In some embodiments, the coupler, when mounted on the package, is adapted to being held immovable in a fixed location on the package.

In some embodiments, the coupler body, when mounted on the package, is adapted to being movable back and forth along the interlocking rails whereby interaction between the coupler and the interlocking rails opens and closes the portion of the zipper over which the coupler is moved.

In some embodiments, the apparatus further comprises an engaging structure which interacts with one of the slider body and the coupler body and thereby releasably latches the cover to the one of the slider body or the coupler body at the engaging structure, such that the latching must be unlatched before the slider body and the coupler body can be released from being coupled to each other.

In some embodiments, the engaging structure comprises a snap latch, and wherein the releasable latching comprises a snap-latching of the engaging structure to an element of the respective slider or coupler, whereby the snap-latching includes building a force which is quickly released as the latching is engaged.

In a second family of embodiments, the invention comprehends apparatus for limiting access to a compartment of a package through a plastic zipper when mounted on the package, the zipper having a length, the apparatus comprising a slider, having a slider body, the slider body comprising a slider channel adapted to interface with first and second interlocking rails on the package, the slider body being adapted to being moved back and forth along lengths of the interlocking rails whereby interaction between the slider channel and the interlocking rails opens and closes the zipper; a coupler, having a coupler body, the coupler being adapted to being attached to the package, the slider and the coupler being configured to be releasably coupled to each other so as to limit access to the compartment of the package through the zipper; and a cover attached to one of the slider and the coupler, and overlying at least half of a length, aligned with the length of the zipper, of a respective one of the slider or the coupler.

In some embodiments, the cover overlies at least a portion of the one of the slider and the coupler to which the cover is attached.

In some embodiments, the apparatus further comprises a first restraining mechanism as part of at least one of the slider body and the coupler body, the first restraining mechanism being designed and configured to engage structure on the other of the slider body and the coupler body, thereby to couple the slider and the coupler to each other.

In some embodiments, the cover is attached to the one of the slider and the coupler at a first location on the cover, the cover further comprising a restraining mechanism by which the cover is releasably coupled, at a second location on the cover, to the one of the slider and the coupler to which the cover is not attached at the first location on the cover.

In some embodiments, the apparatus further comprises a second restraining mechanism, the second restraining mechanism being designed and configured to engage structure of at least one of the slider and the coupler thereby to couple the slider and the coupler to each other.

In some embodiments, the cover is attached to the one of the slider and the coupler by a hinge, and wherein the cover is brought into the overlying relationship by rotating the cover about the hinge.

In some embodiments, the slider body and the coupler body have lengths extending in a same direction with the interlocking rails, the cover overlying the full length of the respective slider body or coupler body.

In some embodiments, the second restraining mechanism comprises a male element on one of the slider and the coupler, and a female receptacle on the other of the slider and the coupler, the male element and the female receptacle being adapted and configured to cooperate with each other in coupling the slider and the coupler to each other.

In a third family of embodiments, the invention comprehends apparatus for mounting on a package having a product-receiving compartment, the package further having a zipper for accessing the product-receiving compartment, the package including a first plastic wall having a first edge, a second plastic wall having a second edge, the zipper having a length, and including first and second interlocking rails at respective ones of the first and second edges of the first and second plastic walls, a slider, and a coupler, such first and second interlocking rails having lengths, the apparatus comprising the slider, having a slider body, the slider body comprising a slider channel adapted to interface with the interlocking rails, the slider body being adapted to being moved back and forth along the lengths of the interlocking rails whereby interaction between the slider channel and the interlocking rails opens and closes the portions of the interlocking rails over which the slider is moved, thereby opening and closing the respective portions of the length of the zipper; the coupler, having a coupler body, and being adapted to being mounted on the package, and to be releasably coupled to the slider body, thus to limit access to the product-receiving compartment through the zipper; and a cover mounted on the package, optionally on one of the slider body or the coupler body, the cover comprising a snap-engaging latch structure which interacts with at least one of the slider body and the coupler body and thereby releasably latches the cover to the at least one of the slider body and the coupler body at the snap-engaging latch structure, such that the cover must be unlatched before the slider body and the coupler body can be released from being coupled to each other.

Figure 1:
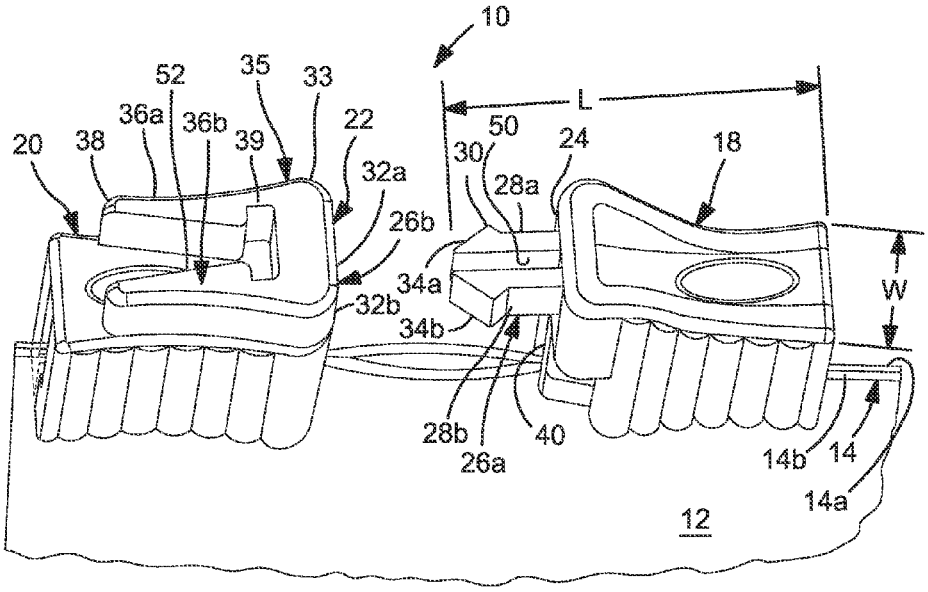
FIG. 1 is a pictorial side view showing a portion of the length of a slider-based zipper having a male locking element on the slider, and a coupler having a female locking receptacle which cooperates with the male locking element to lock/couple the slider and the coupler to each other.

The invention is not limited in its application to the details of construction, or in the arrangement of the components, or in the specific methods set forth in the following description or illustrated in the drawings. The invention is capable of other embodiments or of being practiced or carried out in other various ways. Also, it is to be understood that the terminology and phraseology employed herein is for purpose of description and illustration and should not be regarded as limiting. Like reference numerals are used to indicate like components.

DESCRIPTION OF THE ILLUSTRATED EMBODIMENTS

Figure 2:
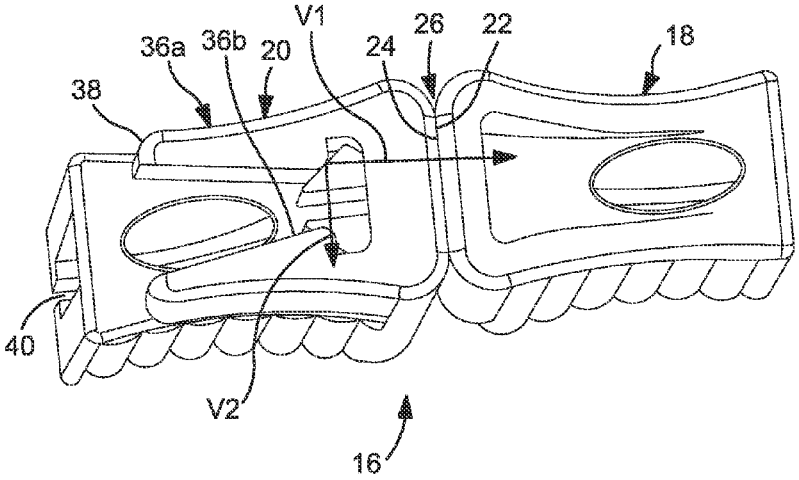
FIG. 2 is a pictorial top view of the slider and coupler of FIG. 1, locked to each other.

FIGS. 1 and 2 show a mechanism 10 for controlling access to a plastic bag 12. Bag 12 has a plastic zipper 14 extending across substantially the full width of the bag at the top of the bag, although only a portion of the bag is shown in FIG. 1. Zipper 14 is defined by facing interlocking rails 14*a*, 14*b* which extend across the width of the bag. In the embodiment illustrated in FIGS. 1 and 2, access-controlling mechanism 10 is defined by a two-piece locking mechanism 16.

The first piece of locking mechanism 16 is a plastic slider 18, having a length "L" extending along the length of the zipper, and a width "W" transverse to the length of the slider. Slider 18 looks much like a conventional slider on a conventional plastic bag which has a conventional plastic zipper. A user opens and closes the zipper by moving/sliding slider 18 back and forth across the width of the bag.

The second piece of the locking mechanism is a plastic coupler 20 which, in the embodiments represented by FIGS. 1 and 2, stays fixed at a given location relative to bag 12 at one side of the bag, astraddle elongate interlocking rails 14*a*, 14*b*.

Both slider 18 and coupler 20 are made of relatively resilient plastic such as polyethylene, polypropylene, nylon, or polyvinylidene chloride (PVDC), whereby certain elements of the slider and the coupler can be designed in cross-section thickness such that parts of the respective such elements are resiliently deflectable, whereby such elements can be moved by moderate force from an unstressed/rest position to a deflected/stressed position and, upon release of such force, the respective element moves generally back toward, optionally substantially to, a previous unstressed position.

By sliding the slider in a first direction, the zipper is opened, providing access to contents of the bag. By sliding the slider in the opposite direction, the zipper is closed, thus at least temporarily closing off access to the contents of the bag. Moving the zipper to the full extent possible in either direction either completely closes off access to the bag or opens the bag to the full extent possible, depending on which direction the slider is being moved.

A first end 22 of coupler 20 faces a second end 24 of slider 18. Ends 22 and 24 have a restraining mechanism, namely cooperating lock elements 26, e.g. male 26*a* and female 26*b* lock elements, which provide a locking function to control, thus to allow or prevent, movement of slider 18 along the length of zipper 14 and away from coupler 20.

In the embodiments illustrated in FIGS. 1 and 2, slider 18 is moved toward, and brought into proximity with, coupler 20. Because both the slider and the coupler are mounted on the interlocking rails, and the respective slider and coupler are cooperatively configured, male lock element 26*a* on slider 18 is automatically in general alignment with female lock receptacle 26*b* on coupler 20 and is so designed as to automatically come into engagement with the female lock receptacle 26*b* on coupler 20, only requiring linear movement of the slider, as at least a portion of end 24 of the slider comes into an abutting, or nearly abutting, relationship with end 22 of the coupler, thus locking the slider to the coupler as end 24 of the slider gets close to, optionally abuts, coupler 20.

In the embodiments illustrated in FIGS. 1 and 2, when the slider is locked to the coupler, the slider cannot be slid across the width of the bag to thereby open the bag because of the coupler being fixed, immovable at a given location relative to the bag, whereby primary access to opening of the bag by an unauthorized user is prevented, controlled. Thus, the addition of coupler 20, as part of locking mechanism 16, with male lock element 26*a* on slider 18 and female 26*b* lock receptacle on coupler 20, and with coupler 20 fixed in position relative to the length of the zipper, is a first embodiment of the invention, illustrated in FIGS. 1 and 2.

In the embodiment illustrated in FIGS. 1-2, male lock element 26*a* has first and second lock fingers 28*a*, 28*b*, spaced from each other, with facing surfaces of the lock fingers extending parallel to each other, and extending toward coupler 20. Each of lock fingers 28*a*, 28*b* has a laterally extending protrusion 30 which extends in the direction of the width "W" of the slider.

Female lock receptacle 26*b* on end 22 of coupler 20 is sized and configured to receive male lock element 26*a* as slider 18 is moved toward coupler 20, with fingers 28*a*, 28*b* experiencing a frictional, resistive engagement with the sides of female lock receptacle 26*b* as fingers 28*a*, 28*b* are received in the female receptacle. Thus, as the spaced male lock fingers enter receptacle 26*b*, leading edges 34*a*, 34*b* of lock fingers 28*a*, 28*b* engage corresponding left and right side walls of female locking receptacle 26*b*, imposing a resistive transverse stress on fingers 28*a*, 28*b* forcing male lock fingers 28*a*, 28*b* to resiliently deflect laterally, transversely toward each other. Typically, but not necessarily, the magnitude of the deflection of the male lock fingers is, enough that such deflection can be readily seen with a naked eye having 20/20 vision, until the lock fingers reach a maximum deflection stress.

As the lock fingers move further inward into receptacle 26*b*, protrusions 30 on the lock fingers move past inwardly-disposed ends of the sidewalls at the opening into receptacle 26*b* whereby the previously-imposed frictional engagement is released and the male lock fingers resiliently move back toward their unstressed, rest orientation, again extending generally parallel to each other as illustrated in FIG. 1.

With the lock fingers so released from the previously-imposed frictional engagement, the combination of the inward movement of the lock fingers into coupler 20 and the lateral/transverse movement of the lock fingers as protrusions 30 move past the ends of the side walls at the opening into the receptacle, brings leading edges 34*a*, 34*b* of the respective lock fingers into close proximity to, optionally into abutting relationship with, release fingers 36*a*, 36*b*, which act as release structure, on coupler 20. Such abutting relationship is shown in FIG. 2 where leading edges 34*a*, 34*b* of male lock fingers 28*a*, 28*b* are in abutting relationship with release fingers 36*a*, 36*b*.

As the leading edges of the lock fingers approach release fingers 36*a*, 36*b* of the coupler, end 24 of slider 18 approaches end 22 of coupler 20. In the relationship shown in FIG. 2, slider 18 is locked to coupler 20 by the locking of lock fingers 28*a*, 28*b* to the coupler at locking receptacle 26*b*, and a first portion of end 24 of the slider is in abutting relationship with a second portion of end 22 of the coupler. With the slider 18 so locked to coupler 20, and with coupler 20 immovable, fixed in, position, relative to bag 12, zipper 14 is closed, and access to the contents of bag 12 is denied.

The lower portion of slider 18 has the usual channel structure 40, open at the bottom of the slider, to receive, to engage, and to disengage the respective interlocking rails 14*a*, 14*b* of zipper 14 so as to facilitate/enable opening and closing of the zipper as slider 18 is moved back and forth along the length of the zipper. Such channel structures 40 are known in the art.

In the embodiments illustrated in FIGS. 1 and 2, the bottom of coupler 20 also has channel structure 40 for receiving the interlocking rails such that any portion of the interlocking rails which are inside/under the coupler, and which are not permanently sealed to each other, are being held closed, or almost closed, by the coupler. However, in embodiments where the coupler is in a fixed, immovable relationship to the zipper as in FIGS. 1 and 2, such that the coupler never moves, the channel structure 40 of the coupler need not be configured to separate/open the zipper. Nonetheless, the channel structure of the coupler may, if desired, be configured to separate/open the zipper.

Still referring to FIGS. 1 and 2, with the slider locked to the coupler, those portions of the zipper which are under both the slider and the coupler are effectively being held closed, or almost closed, by the respective channel structure 40 of the slider and the coupler, while the portions of the zipper which are to the right of the slider were closed by leftward movement of the slider as the slider was moved toward the coupler, and remain closed by the relationships of the interlocked rails with each other.

In the embodiment illustrated in FIGS. 1 and 2, zipper 14 is opened by moving the slider from left to right, namely away from the coupler, and is closed by moving the slider right to left toward the coupler. Restated, any portion of the zipper which is to the left of the slider and to the right of the coupler is open while any portion of the zipper which is to the right of the slider is closed. So, to fully close the zipper, the slider is moved the full length of the zipper to the left, up against the coupler as illustrated in FIG. 2. Alternatively, to fully open the zipper, the slider is moved as far as possible to the right, away from the coupler.

At the top of coupler 20, a body 33 of release element 35 is integral with, or mounted to, or otherwise attached to, coupler 20 at or near the end 22 of coupler 20 which faces slider 18. Release fingers 36*a*, 36*b* extend away from end 22 of coupler 20, across the top of coupler 20 and are movable relative to coupler 20. Terminal ends 38 of the release fingers overlie a left portion of the top of coupler 20. Ends 38 of release fingers 36*a*, 36*b* can be manually squeezed toward each other. Release fingers 36*a*, 36*b*, as extending from body 33, are sufficiently rigid that e.g. squeezing movement of the release fingers toward each other at the ends 38 results in corresponding movement along the entire lengths of the release fingers, especially to the lesser cross-section portions of the release fingers at finger roots 39. Because the cross-sections of the fingers are less at roots 39 than at opposing sides of the roots, taken along the lengths of the release fingers, the lesser cross-section portions of the release fingers at roots 39 operate as pivot points about which the release fingers, to the left of the roots, move/deflect when the ends of the release fingers are squeezed toward each other. When such squeezing force is released, the release fingers resiliently return to, or approximately to, the unstressed positions which are shown in FIGS. 1 and 2.

With male lock fingers 28*a*, 28*b* fully engaged in the female lock receptacle as shown in FIG. 2, leading edges 34*a*, 34*b* of the lock fingers engage facing surfaces of the release fingers such that, as the release fingers are squeezed toward each other, potentially against latent resilient stresses in the lock fingers, the movement of the release fingers toward each other pushes the lock fingers toward each other such that the distance between lateral protrusions 30 is reduced enough that the lateral protrusions can be retracted through the opening at female lock receptacle 26*b*, thereby to release the male lock fingers from the female lock receptacle.

Starting with the zipper fully closed, with the slider locked to the coupler as in FIG. 2, when the user desires to release the slider from coupler 20, namely to open the zipper, or partially open the zipper, the user squeezes e.g. the terminal ends 38 of release fingers 36*a*, 36*b* toward each other. The squeezing of the ends 38 of the release fingers toward each other translates as a corresponding squeezing movement along the lengths of the release fingers to roots 39, and operates to squeeze male lock fingers 28*a*, 28*b* toward each other. As a result of the pivotation of the release fingers about roots 39, the angle of the force received at a leading edge 34*a*, 34*b* of the respective lock finger has both a longitudinal vector "V1" urging the lock finger, and thus the slider, away from the coupler, and a transverse vector "V2", which urges the lock fingers toward each other. Both vectors "V1" and "V2" operate at the same time in response to the forces being exerted on the lock fingers by release fingers 36*a*, 36*b*.

The transverse vector moves the lock fingers toward each other, thus enabling protrusions 30 to move outwardly past the sidewalls at the lock receptacle opening. The longitudinal vector provides the force which causes the protrusions to in fact, move longitudinally without further urging or, in the alternative, which enables the user to easily move the slider out of engagement with the coupler along the direction, and with the assistance of, the longitudinal force vector. In either case, male lock element 26*a* can be retracted from female lock receptacle 26*b* as the ends of the release fingers are squeezed toward each other.

Once the male lock element is retracted from the female lock receptacle, the user releases release fingers 36*a*, 36*b*, whereupon the release fingers resiliently return toward their unstressed positions/orientations as shown in FIGS. 1 and 2. Similarly, once lock fingers 28*a*, 28*b* are retracted from receptacle 26*b*, the lock fingers resiliently return toward their unstressed orientations/positions where the facing surfaces of the lock fingers are again generally parallel with each other.

With the slider released from coupler 20, the slider can be slid along the length of zipper 14 as easily as in a zipper which does not use a coupler, thus to open the zipper and allow respective access to the contents of the bag.

Accordingly, use of coupler 20 in a fixed, unmoving position, coupled to the body of the bag, and/or to the zipper, in combination with the respective male and female lock elements, provides secure locking of the slider at one side of the bag, ensuring that the zipper remains closed, while providing for release of the lock elements using only manual effort, but effort which does require at least modest finger dexterity, optionally more dexterity than can be exercised by a young child, optionally more dexterity than can be exercised by a typical physically handicapped adult.

Thus, in its simplest embodiment, the invention contemplates a slider and a coupler, where the slider and the coupler collectively embody a two-piece locking mechanism which allows the slider and the coupler to be releasably coupled to each other, thereby to prevent unauthorized access to the contents of the bag. While a male/female lock mechanism of a particular structure is illustrated, the lock mechanism can have any design so long as the lock mechanism releasably couples the slider and the coupler to each other.

Factors considered in designing mechanism 10 for controlling, limiting, access to the contents of the package include, without limitation, value of the product to be contained in the package and corresponding potential loss to the owner, the level of danger/risk which the contents of the package pose to an unauthorized user, any legal implications, capacity of contemplated unauthorized users to circumvent and open access-controlling, access-limiting security features, the period of time and the length of time during which unauthorized users may have access to the package, the robustness of the body of the package/bag itself, the use environment, and supervisory and security measures contemplated to be used to secure the environment, to which the package will be exposed, from unauthorized users so that such unauthorized users will not have even short-term access to the bag.

In some contemplated usages, a two-piece, male-female lock mechanism, such as that illustrated in FIGS. 1 and 2, may provide enough control to deter substantially all unauthorized users. However, in other contemplated usages, an enhanced level of looking/security/deterrence is desirable in order to provide reasonable certainty that access to the contents of the package is in fact limited, controlled, to the extent contemplated as being necessary to achieve the objectives defined for the package. Such usage might be where the contemplated unauthorized user may have greater capabilities, such as, relative to some base line capabilities, relatively greater dexterity, greater intellect, and/or more persistence. Another reason for enhanced lock/security is where the product contained in the bag presents an enhanced level of risk to an unauthorized user, or where the product has enhanced value to the owner or to an authorized user.

For example, children learn about their environment, about their world, by playing with items they can touch, feel, and manipulate, by exploring the world, by testing what they can do with whatever items are available to them—for extended periods of such play time. Where such environment, namely including the contents of the respective package, may be dangerous to the child, it is desirable to put in place enough barriers that the child will not be able to access the dangerous portion of the environment, namely the contents of the package, even though the child may have extended periods of time to test and manipulate his/her discoveries. In such instances, a simple primary male/female lock system such as that illustrated in FIGS. 1 and 2 may not provide the level of security necessary to protect the child, whereby a more sophisticated, two-stage locking mechanism, or other enhanced security system, may be desirable/justified.

A limit on reasonableness in designing the security system is that the security system typically need not provide more deterrence, to a particular group of unauthorized users, than is provided by the walls/sheets which make up the body of the package/bag, for example the product-holding receptacle, the inner chamber of the package. Thus, a lock, closure, or other deterrence which is much more difficult to circumvent than penetrating the walls of the package/bag is not an obvious lock or closure for controlling access through the zipper.

Figure 3:
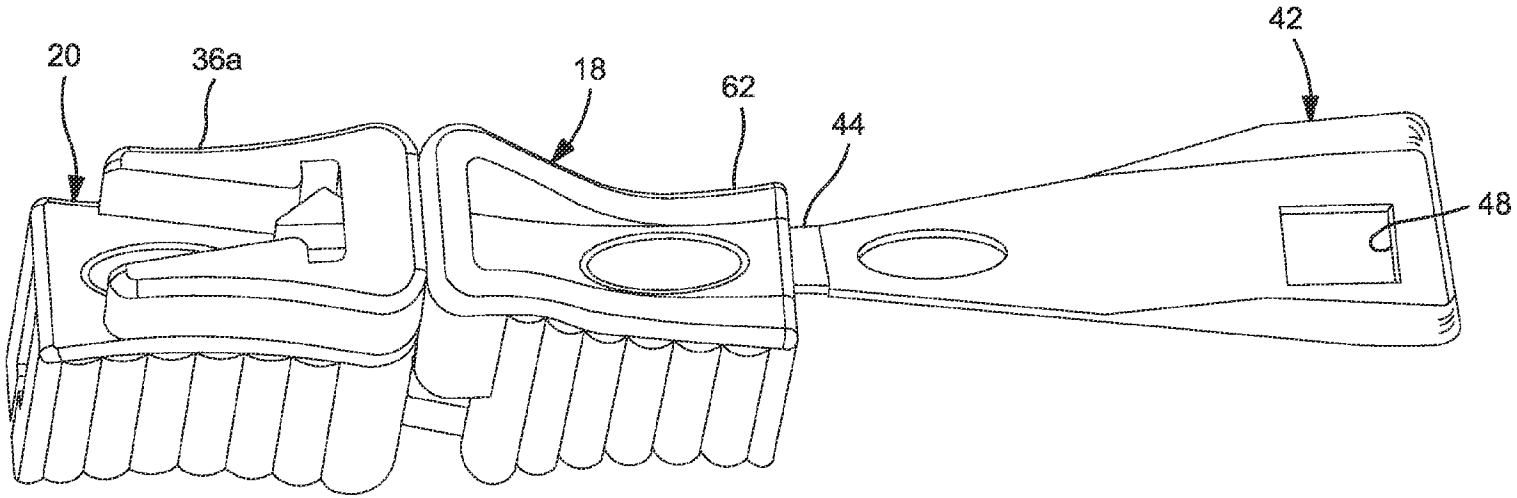
FIG. 3 is a pictorial side view of the slider and coupler of FIGS. 1 and 2 locked to each other, and wherein a cover is mounted to the slider.
Figure 4:
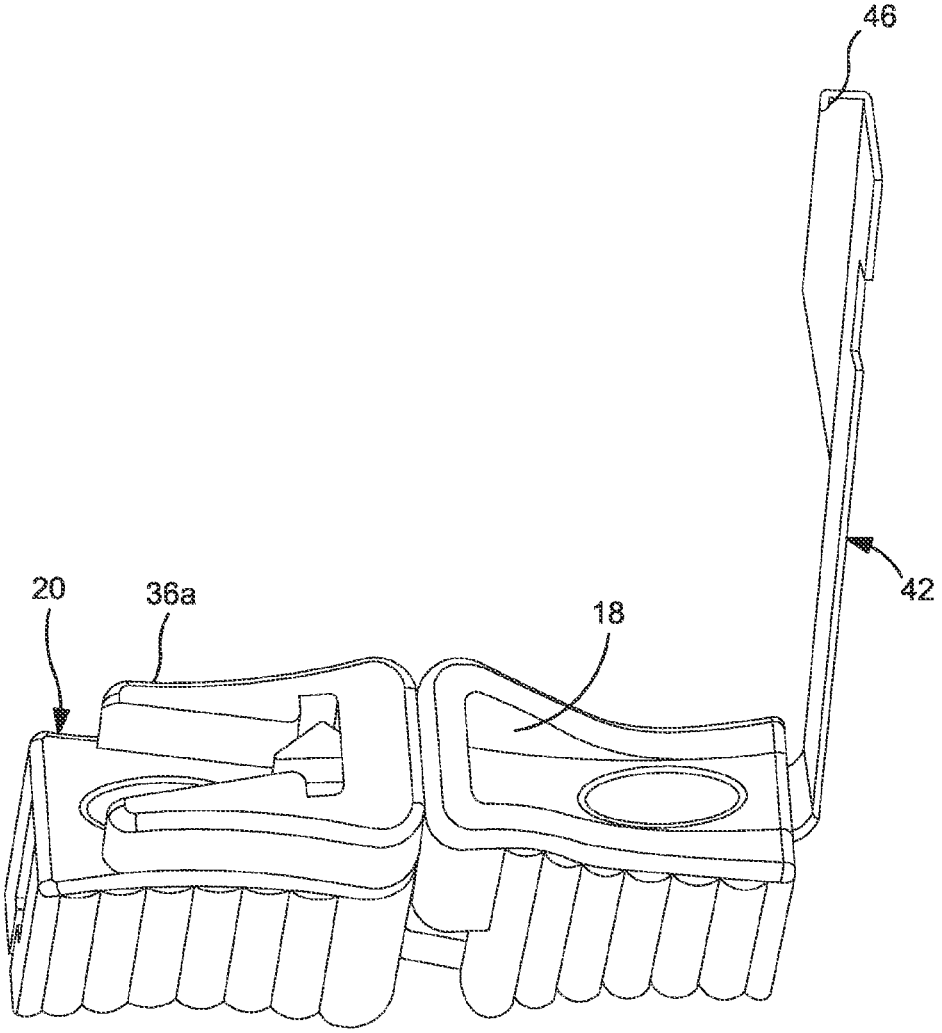
FIG. 4 is a pictorial side view as in FIG. 3, showing a cross-section of the cover raised to an orientation generally perpendicular to the top surfaces of the slider and coupler.
Figure 5:
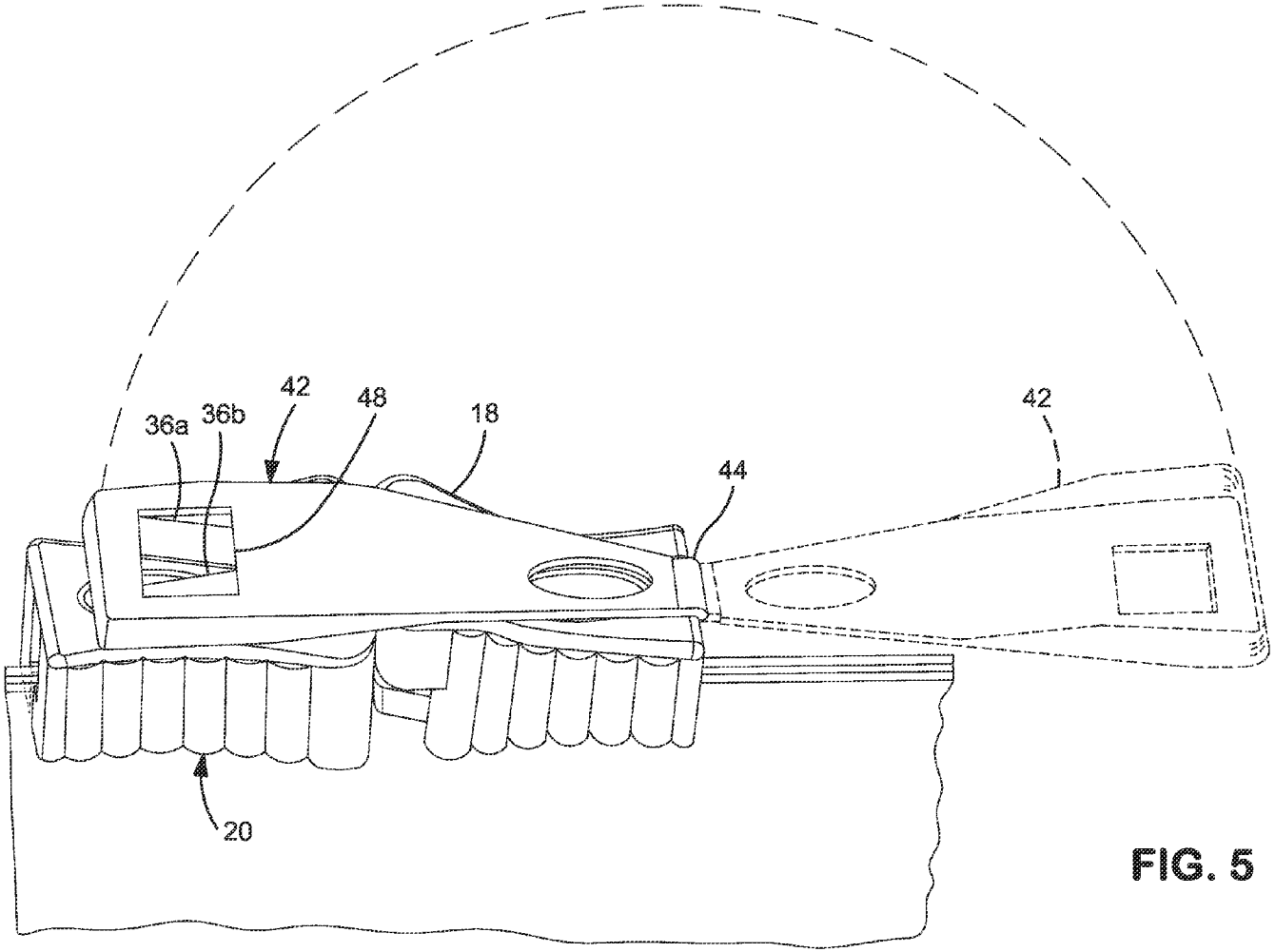
FIG. 5 is a pictorial side view as in FIG. 4, showing the slider and the coupler mounted on a plastic bag, at the zipper, with the cover covering enough of the top surface of the coupler to obstruct ready access to the lock release mechanism which is related to releasing the slider from the coupler.

In the second embodiment, illustrated in FIGS. 3-5, a cover 42, also preferably plastic, is shown incorporated into, or mounted on, or otherwise part of, slider 18. Cover 42 is configured to be rotated about hinge 44, over the slider body and over the coupler, thereby to overlie, and cover the primary locking mechanism, namely over the male and female lock element, namely over the coupling location, specifically over abutting ends 22, 24 where the slider and coupler are coupled to each other, and over the release fingers.

In the rest position of the cover, illustrated in FIG. 3, cover 42 extends away from slider 18, and correspondingly extends away from coupler 20.

With the cover in the covering position, shown in FIG. 5, the cover physically interferes with a user accessing release fingers 28*a*, 28*b*. When the cover is fully seated overrun coupler 20, the cover is releasably engaged with, releasably latched/locked to, the coupler as engaging lip 46 on the cover engages with the ends of release fingers 28*a*, 28*b*. As such, cover 42 acts as a second element, namely in addition to the lock fingers, holding the slider immovably locked to the coupler. Desirably, but not necessarily, more force is required to release, unlock, unlatch the cover from the coupler than can be exerted by the contemplated unauthorized user, e.g. child, of interest.

The cover can, in the alternative, be attached by hinge 44 to the coupler rather than to the slider, and is typically molded as a unitary plastic member of the coupler or slider to which the cover is permanently attached. A plastic hinge such as that illustrated in FIGS. 3-5 is sometimes referred to, known as, a living hinge.

In other embodiments, first and second portions of the cover can be mounted to each of the slider and the coupler whereby the first and second portions collectively cover the release fingers, and collectively lock or latch to the access-limiting mechanism while overlying the release fingers or other coupling location.

In the alternative, the cover can be separately mounted to the material of the body/receptacle of the bag/package, itself, separate from any mounting of the coupler or the slider to the bag/package. Or the cover can be used as a separate element, not attached to the slider, not attached to the coupler, not attached to the package sheet material or any other part of the package. In any such event, and as with all cover configurations, in the covering orientation, the cover overlies/covers and/or obscures enough of whatever other structure a user needs to access, namely the coupling location or release elements/fingers, in order to release at least one operative locking/latching mechanism; or otherwise limits/controls access to, physically interferes with, such unauthorized access by way of an operative locking/limiting mechanism. In typical uses, the cover will overlie at least half of the length of the e.g. coupler, taken along the direction of the length of the zipper and may overlie the full length of the coupler or slider.

The embodiments illustrated in FIGS. 3, 4, and 5 also show a coupler 20 and a slider 18, including the same male/female locking mechanism as in FIGS. 1 and 2, and wherein cover 42 is coupled, mounted, or otherwise attached, at a first location on the cover, namely hinge 44, to the right end of the slider. Hinge 44 provides a flexible plastic connection to the slider, where the entire width of the hinge flexes, whereby the cover can be rotated, from its fully open position shown in FIG. 3, counterclockwise to the vertical position shown in FIG. 4, and thence, or continuously, to the closed position shown in FIG. 5. Referring to FIGS. 4 and 5, in the closed position shown in FIG. 5, engaging lip 46 at a second location on the cover, namely at the remote edge of the cover, snap-engages, snap latches, with release fingers 36*a*, 36*b*, requiring enough force to release the cover that the child or other individual of interest does not easily release of the cover from the release fingers.

With the cover so engaged over the release fingers, the release fingers are at least partially obstructed from view such that the availability, usefulness of the release fingers may not be recognized. Such recognition can be further suppressed, avoided by omitting window 48 in the cover.

In any event, the access-controlling/limiting mechanism 10 illustrated in FIGS. 3-5 requires two specific action steps in order to open the zipper. The first step is to release, open cover 42, which does include a preliminary sub-step of releasing snap-locked engagement lip 46 from the release fingers. After the cover has been released and articulated away from release fingers 36*a*, 36*b*, the second step is squeezing the release fingers toward each other to thereby release lock fingers 28*a*, 28*b* from coupler 20. Finally, if the lock fingers are not automatically released from the coupler by force vector "V1", the user pulls the slider away from the coupler while squeezing the release fingers, in an action which requires simultaneous use of both hands—namely a two-handed action. Such requirement for simultaneous use of two hands, in and of itself, irrespective of the structure of the access-controlling mechanism, provides an enhanced level of access control to the process of opening the zipper.

Thus, cover 42 requires a preliminary action step, namely that of releasing the cover, before release fingers 28*a*, 28*b* can be accessed and actuated. Thus, in this embodiment, cover 42 and release fingers 28*a*, 28*b* act as cooperating restraining mechanisms, with the common objective of restraining access to the zipper.

In the alternative, the cover can be foreshortened and narrower at its remote end such that the end of the cover engages either the inner surfaces 50 of male lock fingers 28*a*, 28*b* or the inner surfaces 52 of release fingers 36*a*, 36*b* so as to directly engage the lock fingers or release fingers to prevent/impede either the release fingers from being squeezed toward each other or the lock fingers from being squeezed toward each other.

Still further, the end of cover 42 can engage the rear end of the opening adjacent root 39, thereby independently coupling the slider and the coupler to each other.

Those skilled in the art will now see that a wider variety of structures can be employed to impede, prevent, limit, control a potential user, who has a less-than-full use of nominally-normal adult physical or mental capabilities, from gaining access to, squeezing release fingers 36*a*, 36*b* or lock fingers 28*a*, 28*b*. Again, the objective is that the engagement of the cover, which is mounted on the slider, with either the lock fingers or the release fingers, or other structure on the coupler, is such that the child or other individual of interest is unable to expose and release the primary lock.

In any embodiment contemplating the cover, the cover can as well be mounted to the slider or to the coupler, or to one of the side walls of the bag or other substrate to which the slider controls access, so long as the cover is effective, whether by locking or otherwise, to limit, optionally to prevent, access to whatever structure is responsible for releasing the primary locking elements; or the cover can serve as a second independent restraining mechanism, whereby the primary restraining mechanism 26 and the secondary restraining mechanism, e.g. cover 42, can be released independent of each other.

Still further, the cover can be a two-part cover where both parts can be attached to the slider, both to the coupler, or one each to the coupler and the slider. A two-part such cover can employ its own secondary restraining mechanism which releasably locks the two parts to each other and/or to the slider or to the coupler, or to walls of the package/bag, when the cover overlies the release fingers or other primary release mechanism or otherwise obstructs use of the release mechanism.

Figure 6:
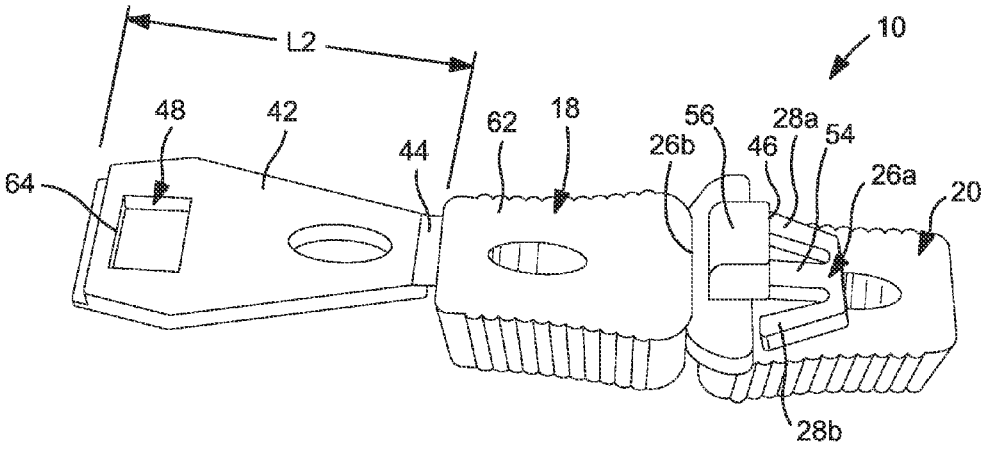
FIG. 6 is a pictorial side view showing a second embodiment of the slider and coupler, including locking elements, the slider including both a first locking element and a second locking element.
Figure 7A:
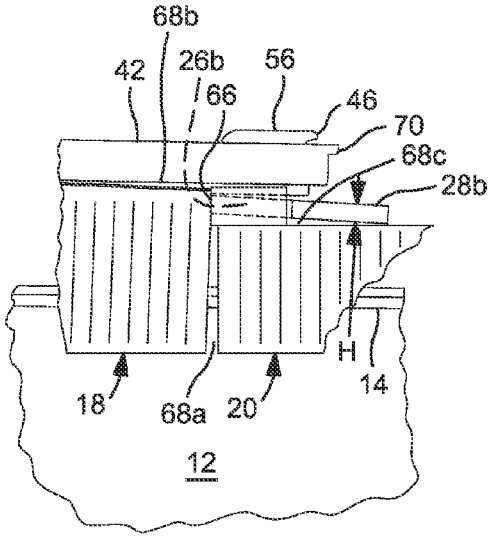
FIG. 7*a* is an enlarged side view of a portion of the coupled slider and coupler of FIG. 7.
Figure 7:
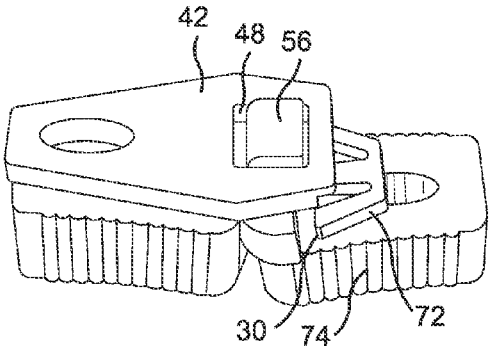
FIG. 7 shows the slider and coupler as in FIG. 6, with both the primary lock and the secondary lock engaged on the coupler.

FIGS. 6 and 7 illustrate a third embodiment of access-limiting, access-controlling mechanisms 10 of the invention. Male lock element 26*a* on slider 18 embodies a central, longitudinally-extending shaft 54 extending from main body 62 of the slider. Lock fingers 28*a*, 28*b* extend rearwardly, back toward the main body, from the remote end of shaft 54.

As in the earlier embodiments, lock fingers 28*a*, 28*b* are compressed, moved toward each other as the male lock element 26*a* is advanced into the female receptacle on the coupler, and such maximum deflection/compressive stress is released once the ends of lock fingers 28*a*, 28*b* move past the side walls of female receptacle 26*b* on the coupler. As in the embodiments of FIGS. 3-5, cover 42 is attached to the main body 62 of slider 18 by a plastic hinge 44, sometimes referred to as a "living" hinge. As illustrated in FIG. 7, after the male-female lock mechanism 26 has been engaged as in FIG. 6, cover 42 is rotated/pivoted about hinge 44, and window 48 on the cover is frictionally snap-engaged over riser 56 on the coupler, reinforcing the force used in holding the slider in abutting engagement with the coupler.

While the primary male-female lock mechanism 26, illustrated in FIGS. 6 and 7, locks the slider to the coupler, such lock may, depending on the lengths of lock fingers 28*a*, 28*b*, enable limited longitudinal movement of the slider and coupler toward and away from each other. The engagement of the cover over riser 56, by contrast, requires tight/firm abutment of the end of the slider against the coupler, with the closing/locking of window 48 over riser 56 locking the slider and coupler tightly against each other.

The engagement of cover 42 on riser 56 can include snap-latching of window 48 into a suitably-positioned detent in the corresponding surface of riser 56.

Such snap latching is affected by engagement of remote side wall 64 of window 48 with protruding engaging lip 46 on riser 56. Length "L2" of cover 42 is dimensioned such that the distance between hinge 44 and remote cover side wall 64 is less than the distance between the hinge end of the coupler and the remote end of lip 46 on riser 56 when the coupler and slider are engaged to each other. Thus, as side wall 64 moves past engaging lip 46, by the force being applied to the cover at riser 56 causes the slider to pivot, rotate, flex the hinge end of the cover, and thus the slider body, up a few degrees relative to the coupler, and about the locus of abutment 66 of the slider and coupler, so as to create a first small-angle wedge-shaped space 68*a* between slider 18 and coupler 20, and a second small-angle wedge-shaped space 68*b* between the top of the slider body and the bottom of the cover. Corresponding flexing in the side walls of the bag adjacent the slider and coupler accommodates such angular movement at the interface where the coupler and slider meet. The rounded shape of engaging lip 46 accommodates respective movement of remote edge 64 of window 48 about and downwardly past the lip as the user applies downward force on the window remote edge at riser 56. When enough force has been applied, the remote edge of the window moves past lip 46 whereupon the built-up force/stress is quickly, suddenly released as the cover window snap-engages/latches to riser 56.

With the cover so snap-latched to the riser, wedge-shaped spaces 68*a*, 68*b* remain intact, maintaining a continuing stress/force holding the slider firmly in abutting relationship with the coupler at abutment locus 66.

Starting with the closed zipper, with the slider and coupler coupled to each other, and with cover 42 locked onto coupler 20 at riser 56, as illustrated in FIG. 7, to disengage the slider from the coupler, as a first step, cover 42 is released from riser 56. To release cover 42 from riser 56, the user engages end lip 70 of the cover with a finger or finger nail, and raises the end of the cover past lip 46 on the riser, thus releasing the cover from the coupler.

As a second step, once cover 42 has been released, and deployed away from the riser, lock fingers 28*a*, 28*b* are squeezed together and the slider is manipulated away from the coupler. Again, substantial manual strength and dexterity, and again typically required use of both hands—one squeezing the lock fingers toward each other, and the second hand manipulating the slider away from the coupler is required to affect this second step. Such requirement for simultaneous use of 2 hands is effective to defeat any potential user having less than normal adult strength and/or adult dexterity in both hands, from accessing the contents of the package.

As seen in FIGS. 6, 7, and 7*a*, release fingers 28*a*, 28*b* are angled down from female receptacle 26*b* and the ends of the fingers are shown substantially touching the top surface of coupler 20. In accord with the following more-detailed description, it is highly acceptable for the ends of the fingers to actually touch the top surface of the coupler. Such downward angle of the release fingers relative to the top surface of the coupler defines third wedge-shaped spaces 68*c* between the bottom surfaces of the release fingers and the top surface of the coupler. Such wedge-shaped spaces collectively express a tension being imposed on the abutment coupling of the coupler and the slider by the latching of cover 42 on riser 56.

In addition, the outer edges 72 of release fingers 26*a*, 26*b* are disposed inwardly of side surfaces 74 of the coupler body. Yet further, release fingers 26*a*, 26*b*, as illustrated, have a height "H" of about 1 mm to about 3 mm, optionally about 1 mm to about 2 mm, optionally about 1 mm to about 1.5 mm. Thus, the release fingers are limited in height, are touching, or substantially touching, the top surface of the coupler, are displaced inward of side surfaces 74 of the coupler body, and the effective height of the fingers above the top surface of the coupler body is no more than 3 mm, optionally no more than 2 mm, optionally about 1 mm to about 1.5 mm. The outer edges of the release fingers are displaced inwardly, toward each other, from the side surfaces of the coupler body by at least 0.5 mm, optionally at least 1 mm.

Given the above dimensions and positioning as illustrated in FIGS. 6, 7, and 7*a*, a user attempting to use the soft flesh of e.g. the thumb and forefinger to squeeze release fingers 28*a*, 28*b* toward each other far enough to get protrusions 30 past the side walls of female receptacle 26*b*, will fail. Rather, the limited height and the inward deployment of the release fingers, against the top surface of the coupler does not provide enough surface contactable with enough force by the soft tissue of a human finger, whereby use of soft finger flesh alone, to squeeze the release fingers enough to affect release of the slider from the coupler fails to move the release fingers by the required amount to release the slider from the coupler.

Rather, some hard object, hard tool, such as a small pliers, or fingernails, are required to apply sufficient force to the release fingers to get the fingers sufficiently squeezed for the release fingers to get through female receptacle 26*b*.

In other embodiments, where less restriction on opening of the package is acceptable, the engagement surfaces of the release fingers which are engaged by a user's human fingers can have a greater height "H", or can be located further outwardly away from each other and outwardly relative to the outer surfaces of the sidewalls of the coupler, or both. Such modifications provide release fingers which are readily engaged by the soft flesh of an adult human user's fingers, and squeezed toward each other, enough to enable movement of the release fingers through the female receptacle, thus to release the slider from the coupler.

Once the release fingers 28*a*, 28*b* are sufficiently squeezed to clear receptacle 26*b*, a force is still required to move the slider longitudinally away from the coupler. But both the slider body and the coupler body are tapered, narrowing in width from abutted ends 22, 24 to the opposing remote ends. Such taper, narrowing frustrates facile gripping of the coupler and slider, particularly where substantial effort is being simultaneously exerted in squeezing release of fingers 28*a*, 28*b*.

Accordingly, the configurations and dimensioning of the various piece parts of the coupler and the slider play major roles in frustrating attempts of the unauthorized user to open the zipper.

Figure 8:
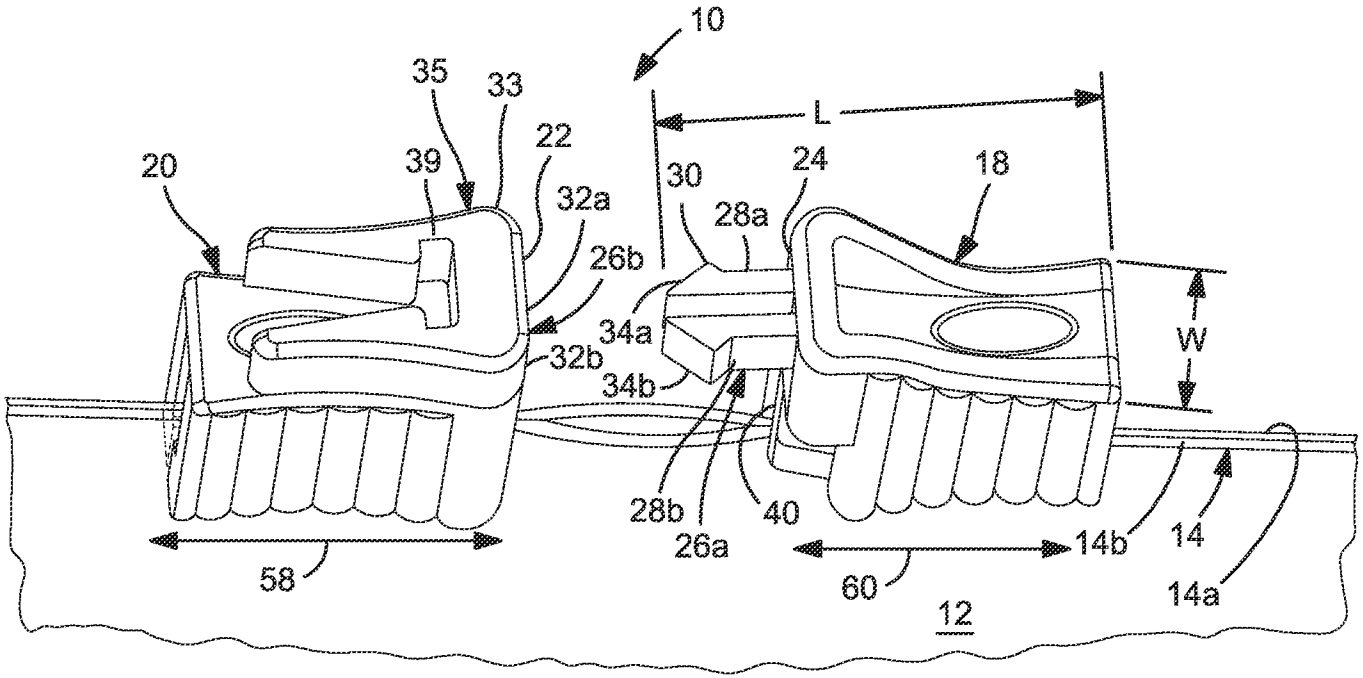
FIG. 8 is a pictorial side view showing a portion of the length of a slider-based zipper having a male locking element on the slider, and a coupler having a female locking element which cooperates with the male locking element to lock the slider and the coupler to each other, and wherein both the slider and the coupler can slide along the length of the zipper.

FIG. 8 shows an embodiment of access-controlling mechanism 10 wherein coupler 20 is not immovably fixed in position relative to the bag/zipper. Rather, the coupler can be moved left or right along the length of the zipper as suggested by the double-headed arrow 58. Correspondingly, the slider can be moved left or right along the length of the zipper as suggested by double-headed arrow 60. Such movement of the slider and coupler can take place when the slider and zipper are locked to each other, and also while the slider and coupler are not locked to each other.

In the embodiments represented by FIG. 8, the structure of zipper channel 40 in the coupler is configured similar to the structure of the zipper channel in the slider. Namely, the structure of the coupler zipper channel is a mirror image of the channel structure in the slider whereby the coupler closes the zipper when moved from left to right while the slider closes the zipper when moved from right to left. As a result, the zipper is closed by bringing the slider and coupler together and is opened by separating the slider and coupler from each other. Those portions of the length of the zipper which are under coupler 20, and those portions of the length of the zipper which are to the left of coupler 20, are always closed. Those portions of the length of the zipper which are under slider 18, and those portions of the zipper which are to the right of slider 18, are always closed. Accordingly, when the slider and coupler are locked to each other, the full length of the zipper is always closed, irrespective of where, along the length of the zipper, the locked slider/coupler combination is. And with the slider and coupler locked together in abutting relationship, the locked combination of slider and coupler can be moved along the length of the zipper with the full lengths of the interlocking rails of the zipper remaining effectively closed, locked to each other irrespective of where that locked combination is along the length of the zipper.

As the slider and coupler are unlocked from each other and moved away from each other, the portion of the length of the zipper which is between the slider and the coupler is opened as illustrated in FIG. 8, by the movement of either the slider or the coupler, or both.

Restated, if/as the slider is moved to the right, that portion of the zipper which is traversed by the slider, and which is then to the left of the slider and to the right of the coupler, is opened by the movement of the slider, by virtue of the zipper-opening/closing structure in the zipper channel 40 of the slider.

Similarly, if/as the coupler is moved to the left, that portion of the zipper which is traversed by the coupler, and which is then to the right of the coupler and to the left of the slider, is opened by the movement of the coupler, by virtue of the zipper-opening/closing structure in the zipper channel 40 of the coupler.

In this embodiment, for releasing the locking elements 26, 28 from each other, typically the user needs to use two hands simultaneously on access-controlling mechanism 10. As the locking elements of the access-controlling, access limiting mechanism are released from each other, even such minimal movement of the coupler or slider as is required for such lock release, opens a short length of the zipper. Once the lock elements are released from each other, any further movement of either the slider or the coupler away from the other of the slider or the coupler opens a corresponding portion of the length of the zipper. The maximum available length of opening of the zipper occurs when bath the slider and the coupler are moved as far as possible along the length of the zipper, away from each other, typically to opposing edges of the bag on which the slider and coupler are mounted.

The zipper can be subsequently re-closed by moving either the slider or the coupler, or both, toward the other of the slider or the coupler, and again securing the lock elements to each other. Such securement of the lock elements to each other is suggested in FIG. 2.

While the coupler is shown on the left and the slider on the right in FIGS. 1-5 and 8, such positions can be reversed with no loss of functionality as suggested in FIGS. 6-7. Indeed, accomplishing such reversal of the perceived respective left/right positioning of the coupler and slider, can be effected by simply rotating the respective plastic bag 180 degrees about a vertical axis.

In yet another embodiment, the zipper can extend less than the full length, full corresponding dimension, of the package.

Figure 9:
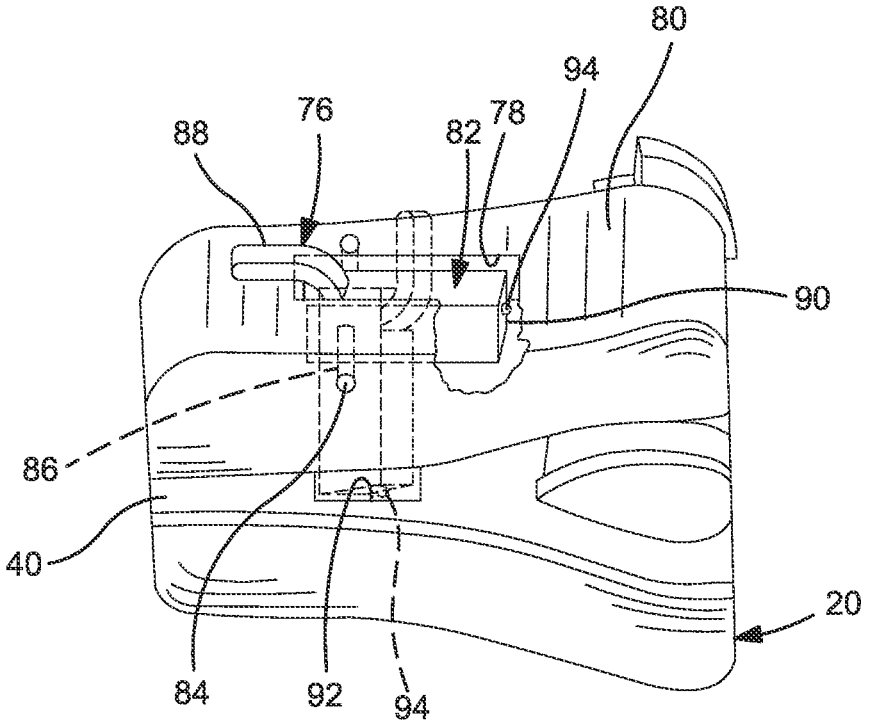
FIG. 9 is a pictorial bottom view, with part cut away, of a coupler of the invention, illustrating a coupler lock structure for locking the coupler immovable, optionally releasably immovable, along the length of the zipper.

In another embodiment illustrated in FIG. 9, coupler 20 is slidable along the length of the zipper. A separate and distinct lock structure 76 is provided on the coupler for locking, optionally releasably locking, the coupler to the bag at a desired location along the length of the zipper.

Referring to lock structure 76, a slot 78 extends from the outer surface of side wall 80 of the coupler to the interior wall of zipper channel 40. A lock bolt 82 is mounted in slot 78 by a pivot pin 84 which extends through a bore 86 in the coupler. Bore 86 extends in a straight line from the bottom of coupler 20 to slot 78, and further into the coupler body above slot 78.

As an alternative to bore 86 and pivot pin 84, protuberances on the top and bottom of the lock bolt can be snap-connected into corresponding recesses/detents in the top and bottom walls of slot 78.

A control lever 88 extends from the body of lock bolt 82 and lies along, but spaced from, side wall 80 of the coupler.

In use of lock structure 76, coupler 20 is moved to the desired position along the length of the zipper. Having reached the desired position along the length of the zipper, the user lifts control lever 88 away from its rest position shown in solid lines in FIG. 9, thus rotating the remote end 90 of the lock bolt inwardly about pivot pin 84 into channel 40 and against the side wall of the bag to which the coupler is mounted. The lifted control lever and respective rotated lock bolt, are shown in dashed outline in FIG. 9. Such rotation of the lock bolt traps the side wall of the bag against the opposing side wall of channel 40 of the coupler. FIG. 9 shows an optional detent 92 which can receive both the bag side walls and the remote end 90 of the lock bolt, thus locking the side walls of the bag in the detent.

If/When the user desires to move the so-locked coupler along the length of the zipper, the user returns the control lever back against the side wall of the coupler as shown in solid line in FIG. 9. A snap latch such as protuberance 94 can be employed e.g., on the remote end of lock bolt 82, to cooperate with a respective female detent on the wall of slot 78 which faces remote end 90 when the lock bolt is in the retracted position shown in solid lines. Protuberance 94 can also engage detent 92 as lock structure 76 is holding the coupler locked against the side walls of the bag in immovable position along the length of the zipper.

This, or other, releasable coupler lock structure is effective to releasably lock the coupler in an immovable, fixed location along the length of the zipper. Namely, the coupler can be selectively locked in a desired position on the zipper, thus to limit the length of the zipper which can be traversed by the slider. Such locking typically engages the lock structure of the coupler with elements of the zipper, or to other element(s) of the packaging structure.

The coupler lock structure can be configured such that the locking can be either permanent, whereby the coupler cannot be later released and moved, or can be releasable.

Where the locking of the coupler to the zipper is releasable, the coupler is releasably locked in position at a desired location along the length of the zipper, which limits the portion of the length of the zipper which can be traversed by the slider, thus limiting the portion of the zipper which can be opened. If, when the user desires to move the slider along a greater portion of the length of the zipper, thus to open a greater portion of the length of the zipper, the coupler is unlocked and is moved to the desired location which provides greater length traverse by the slider, and the coupler is then again releasably locked in position at that location along the length of the zipper. The slider is then able to traverse a greater portion of the length of the zipper.

If, when the user desires the slider to be able to traverse a lesser portion of the length of the zipper, the coupler is unlocked from its position along the length of the zipper and is moved to the new desired position location which provides a lesser length of the zipper which can be traversed/opened by the slider.

By selecting the location along the length of the zipper at which the coupler is positioned, and fixed in location, the user can tailor the size of the opening created by the slider in dispensing the package contents from the package. By providing for the coupler to be releasably fixed, the package enables the user to determine the size of the dispensing opening according to the contents of the package, or according to the amount of product desired to be dispensed, or the rate at which product is to be dispensed. Further, where less than all of the product is dispensed from the package at a given time, thus where a first portion of the product is dispensed, and the dispensing is stopped, and a second portion of the product is to be dispensed at a later time, the provision for the coupler to be releasably fixed enables the package user to dispense the first portion of the product through a first size opening and to dispense the second portion of the product through a second different size opening.

Figure 10:
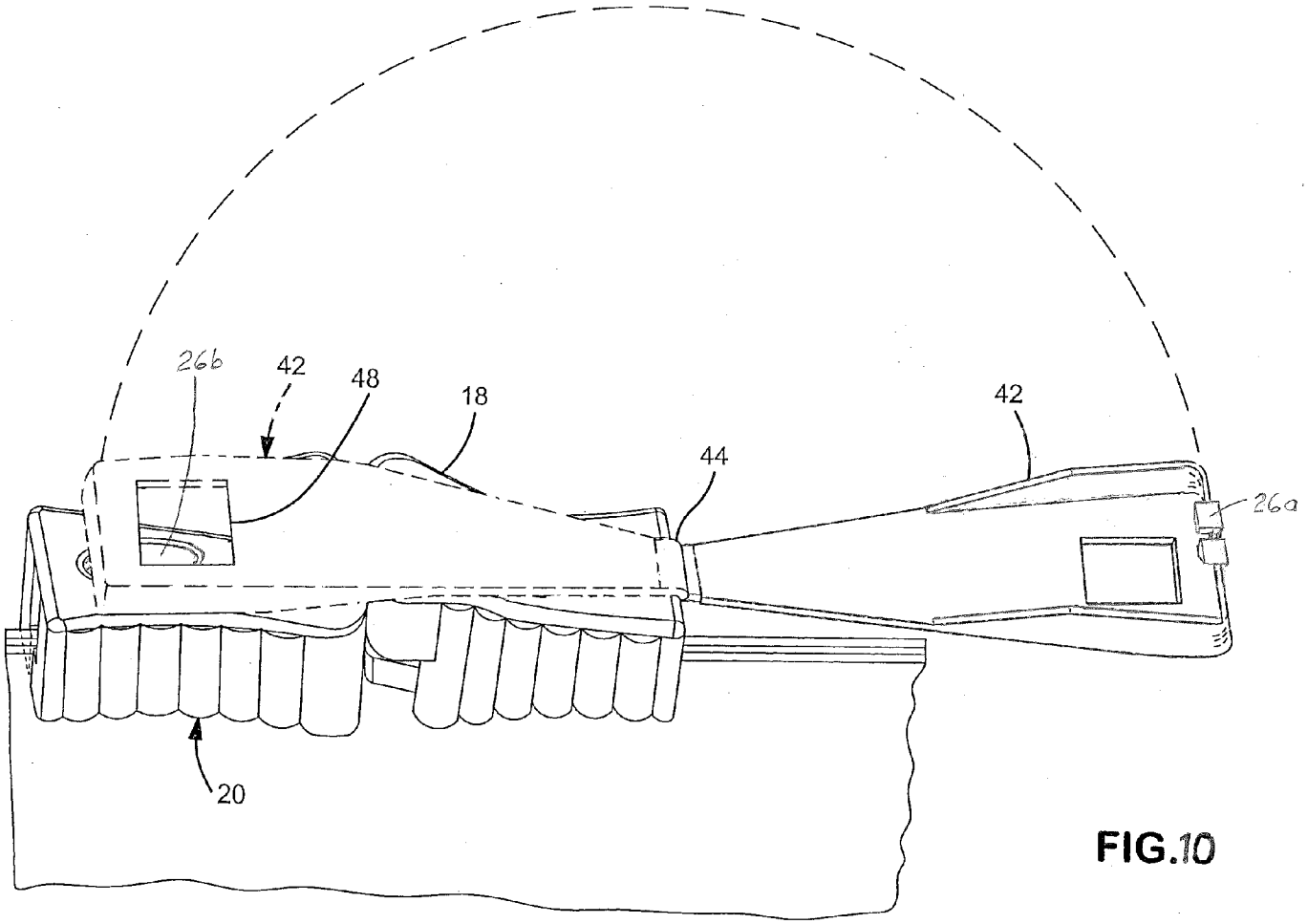
FIG. 10 is a pictorial side view wherein the male lock structure articulates to an overlying position over a female receptacle extending downwardly from the top surface of the coupler.

In yet another embodiment illustrated in FIG. 10, the female lock receptacle 26*b* can be designed, configured, embodied in the top, e.g. the top surface of e.g. the coupler. The male lock fingers 28, or other male lock structure which is locked into the female lock receptacle, extends from a hinge such as hinge 44 and can be articulated, from a rest position displaced from the interface of slider 18 and coupler 20, similar to the rest position shown for cover 42 in FIG. 3, to an overlying position as shown in FIG. 5 where the e.g. male lock structure on the slider interfaces with, snap-engages with, a female lock receptacle on the coupler, similar to the snap-engagement illustrated in FIGS. 5, 6, and 7. Of course, receptacle 26*b* can be in the top surface of slider 18 and the male lock fingers articulate from coupler 20 into such recess.

In some embodiments, coupler 20 embodies a cover 42, having a hinge 44, which is articulated, pivoted as in FIGS. 4 and 5, over the release elements of the lock structure after the operative locking elements are locked together, whereby such cover operates as an obstruction, obstructing access to the respective release elements of the locked-together, access-limiting restraining mechanism, illustrated by lock structure 26.

As in the other embodiments, each of the male and female lock elements can be used on either the slider or the coupler, so long as one of the slider and the coupler bears the male lock element and the other of the slider and the coupler bears the female lock receptacle.

While male and female lock structures have been illustrated, other types of lock structures, which need not fit the "male" or "female" designations can be substituted on the slider and coupler, so long as the respective lock elements can be releasably secured to each other for controlling, limiting access to the contents of the package.

Where the coupler is permanently, immovably fixed in position relative to the zipper, coupler 20 need not be mounted on the interlocking rails of the zipper. Rather, the coupler can be mounted to the zipper, or on essentially any other element of the package/bag, such as to one or more of the package walls. What remains important is that respective lock element 26*a* or 26*b* which is embodied in the coupler be appropriately aligned with the corresponding lock elements 26*a* or 26*b* which is/are embodied in the slider, enough to enable the slider and the coupler to be coupled to each other only requiring linear movement of the slider. Or an engaging lip on the one of the slider and coupler to which the cover is not hingedly mounted engages a window or other cooperating structure of the cover, as illustrated in FIGS. 6, 7, 7*a*. Accordingly, the coupler can be releasably coupled to the slider by only cover 42.

In some embodiments, male element 26*a* and female receptacle 26*b* are omitted, and cover 42 provides the only lock structure locking the slider and coupler to each other. In such instance, engaging lip 46, or other engaging structure on the cover, engages a selected structure on the one of the slider and coupler to which the cover is not hingedly mounted. Or an engaging lip, or other engaging structure, on the one of the slider and coupler to which the cover is not hingedly mounted engages a window or other cooperating structure of the cover, as illustrated in FIGS. 6, 7, and 7*a*. Accordingly, the coupler can be releasably coupled to the slider by only cover 42.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. Apparatus for limiting access to a compartment of a package through a closure when said apparatus is mounted on such package, such closure having a length, said apparatus comprising:

(a) a slider, comprising a slider channel adapted to interface with first and second elongate interlocking plastic rails on such package, said slider being adapted to being moved back and forth along lengths of such elongate interlocking plastic rails whereby interaction between said slider channel and such elongate interlocking plastic rails opens and closes portions of such elongate interlocking plastic rails over which said slider is moved;

(b) a coupler adapted to interface with such package, said coupler and said slider being configured to be releasably coupled to each other;

(c) release structure adapted and configured to effect release of said slider and said coupler from each other; and (d) a cover attached to one of said slider and said coupler by a hinge, said cover being adapted to being in a covering relationship over said release structure when said slider and said coupler are coupled to each other, said hinge, when said cover is in such covering relationship over said release structure, being biased toward movement of said cover away from such covering relationship and to a cover position accompanied by relatively less stress in said hinge.

2. Apparatus as in claim 1, said cover being attached to one of said slider and said coupler at an end of said one of said slider and said coupler which is remote from the other of said slider and said coupler.

3. Apparatus as in claim 1, said cover further comprising an engagement mechanism by which said cover releasably engages said release structure.

4. Apparatus as in claim 1 wherein said hinge is resiliently flexed when said cover is moved from a rest position, which rest position is accompanied by either no flexural stress or a relatively lower flexural stress condition in said hinge, to a position overlying said release structure, which overlying position is accompanied by a relatively greater flexural stress condition in said hinge.

5. Apparatus as in claim 1 wherein said cover is attached to said one of said slider and said coupler by a living hinge, and wherein, when said living hinge is in a rest condition, said cover extends, from said hinge, away from the other of said slider and said coupler.

6. Apparatus as in claim 5 wherein said cover is brought into such covering relationship over said release structure by rotating said cover about said hinge.

7. Apparatus as in claim 1, further comprising, as a restraining mechanism, a male element on one of said slider and said coupler, and a female receptacle on the other of said slider and said coupler, said male element extending in a direction along lengths of such elongate interlocking plastic rails to a remote end of said male element.

8. Apparatus as in claim 7, said male element comprising first and second lock fingers, and wherein said release structure comprises first and second release fingers, which release fingers are deflected toward each other in affecting said slider and said coupler being released from each other, and wherein such deflection of said release fingers toward each other deflects said lock fingers toward each other.

9. Apparatus as in claim 7, said release structure comprising first and second release fingers, said release fingers engaging and deflecting said male element in affecting said slider and said coupler being released from each other.

10. Apparatus as in claim 7, said release structure comprising first and second release fingers, said release fingers being embodied in said male element, said release fingers being deflected toward each other in affecting said slider and said coupler being released from each other.

11. Apparatus as in claim 7, said release structure comprising first and second release fingers, and wherein said release fingers have heights "H" of no more than 3 mm.

12. Apparatus as in claim 1, further comprising an engaging structure on said cover which interacts with one of said slider body and said coupler body and thereby releasably latches said cover to said release structure.

13. A package comprising apparatus as in claim 1.

14. Apparatus for limiting access to a compartment of a package through a closure comprising first and second elongate interlocking plastic rails when said apparatus is mounted on such package, such closure having a length, said apparatus comprising a slider and a coupler, said slider having a slider body, said slider body comprising a slider channel adapted to interface with the first and second elongate interlocking plastic rails, said slider being adapted to being moved back and forth along lengths of such elongate interlocking plastic rails whereby interaction between said slider channel and such elongate interlocking plastic rails opens and closes portions of such elongate interlocking plastic rails over which said slider is moved, said slider having a first proximal end facing toward said coupler and a first remote end facing away from said coupler, said coupler having a coupler body, said coupler body comprising a second channel adapted to interface with the first and second elongate interlocking plastic rails, said coupler body having a second proximal end facing toward said slider and a second remote end facing away from said slider, said coupler being adapted to being attached to such package, a first restraining mechanism designed and configured to provide an initial coupling and restraint of said coupler and said slider to each other as a result of at least one of said slider and said coupler sliding along the length of such closure and the first and second ends of said slider and said coupler reaching engaging relationship with each other wherein any movements of said slider body and said coupler body only require linear movements, and a second restraining mechanism, separate and distinct from the first restraining mechanism, said second restraining mechanism being designed and configured to overlie one of said slider body and said coupler body and to engage an engagement surface of the one of said slider body and said coupler body, the engagement surface facing away from the other of said slider body and said coupler body thereby to hold said slider and said coupler coupled to each other by said second restraining mechanism by other than sliding of said slider on such elongate interlocking plastic rails.

15. Apparatus as in claim 14, said second restraining mechanism comprising a cover attached to said one of said slider and said coupler by a hinge wherein an entirety of a width of said hinge is resiliently flexed when said cover is moved from a rest position, which rest position is accompanied by either no flexural stress or a relatively lower flexural stress condition in said hinge, to a position overlying portions of both said slider and said coupler, which overlying position is accompanied by a relatively greater flexural stress condition in said hinge.

16. Apparatus as in claim 15 wherein said cover is attached to one of said slider and said coupler by a living hinge and, when said living hinge is in a rest condition, said cover extends, from said hinge, away from the other of said slider and said coupler.

17. Apparatus as in claim 15 wherein said cover is attached to said one of said slider and said coupler by a living hinge.

18. Apparatus as in claim 14 wherein said first restraining mechanism comprises a male element on one of said slider body and said coupler body, and a female receptacle on the other of said slider body and said coupler body, said male element and said female receptacle being adapted and configured to cooperate with each other in coupling said slider and said coupler to each other.

19. A package comprising apparatus as in claim 14.

20. Apparatus as in claim 14 wherein said second restraining mechanism comprises a cover attached to one of said slider or said coupler, and wherein said cover engages the other of said slider or said coupler by articulating about a hinge which is remote from any portion of said first restraining mechanism and snap-engaging the engagement surface.

21. Apparatus as in claim 14, said coupler being adapted to sliding along the lengths of the first and second elongate interlocking plastic rails.

22. Apparatus for limiting access to a compartment of a package through a closure when mounted on such package, such closure having a length, and including first and second elongate interlocking rails, said apparatus comprising:

(a) a slider comprising a slider channel adapted to interface with such elongate interlocking plastic rails, said slider being adapted to being moved back and forth along the length of such closure whereby interaction between said slider channel and such closure opens and closes portions of such closure over which said slider is moved;

(b) a coupler adapted to being mounted on such package, and to be releasably coupled to said slider; and (c) a cover mounted on one of said slider and said coupler by a hinge, said cover comprising a snap-engaging latch structure which engages a respective protruding latch structure on the other of said slider and said coupler and thereby releasably latches said cover to the respective one of said slider and said coupler at said snap-engaging latch structure, such cover having a length less than a distance between said hinge and said latch structure on the other of said coupler and said slider such that, as said snap-engaging latch structure on said cover engages said protruding latch structure, at least one of said coupler and said slider rotates relative to the other of said coupler and said slider so as to create a wedge-shaped space (68*a*) between said slider and said coupler when respective ends of said coupler and said slider are in abutting relationship, which wedge-shaped space persists when said cover is fully latched to said protruding latch structure.

23. A package comprising apparatus as in claim 22.

24. Apparatus as in claim 22, said coupler and said slider being also latched to each other by a male element on one of said slider and said coupler and a female receptacle on the other of said slider and said coupler, further comprising a second wedge-shaped space (68*c*) between a bottom of said male element and a top surface of the other of said slider and said coupler.

25. Apparatus for limiting access to a compartment of a package through a closure when said apparatus is mounted on such package, said apparatus comprising:

(a) a slider, having a top surface and a bottom, and comprising a slider channel adapted to interface with first and second elongate interlocking plastic rails on such package, said slider being adapted to being moved back and forth along the lengths of such elongate interlocking plastic rails whereby interaction between said slider channel and such elongate interlocking plastic rails opens and closes portions of such elongate interlocking plastic rails over which said slider is moved;

(b) a coupler, having a top surface and a bottom, said coupler being adapted to being attached to such package;

(c) a female receptacle extending from the top surface of one of said slider or said coupler toward the bottom of the respective said slider or coupler; and (d) a cover comprising a male element, said cover extending from the other of said slider or said coupler, said cover articulating about a hinge to an overlying position over the one of said slider or said coupler, and wherein, with said cover in such overlying position, an engagement finger of said male element extends from the top surface of said one of said slider or said coupler in a downward direction into said female receptacle toward the bottom of said one of said slider or said coupler.

26. A package comprising apparatus as in claim 25.

27. Apparatus for limiting access to a compartment of a package through a closure comprising first and second elongate interlocking plastic rails when said apparatus is mounted on such package, said apparatus comprising:

(a) a slider, having a slider body, and comprising a slider channel adapted to interface with first and second elongate interlocking plastic rails, said slider being adapted to being moved back and forth along lengths of such elongate interlocking plastic rails whereby interaction between said slider channel and such elongate interlocking plastic rails opens and closes portions of such elongate interlocking plastic rails over which said slider is moved;

(b) a coupler, having a coupler body, said coupler body comprising a second slider channel adapted to interface with such first and second elongate interlocking plastic rails, and to being moved back and forth along the lengths of such elongate interlocking plastic rails;

(c) a two-stage coupling mechanism configured to releasably couple said coupler and said slider to each other on such package, said two-stage coupling mechanism comprising (i) a first coupling structure comprising first and second cooperating elements of said coupler and said slider, moveable into a first stage coupling engagement wherein any movements of said slider body and said coupler body only require linear movements, wherein said first and second cooperating elements engage with each other, thereby coupling said coupler and said slider to each other, and (ii) a second coupling structure comprising third and fourth cooperating elements of said coupler and said slider, each of said third and fourth cooperating elements being distinct from said first and second cooperating elements, said third cooperating element being moveable into a second stage coupling engagement with said fourth cooperating element wherein said third and fourth cooperating elements engage with each other, thereby providing a second stage coupling of said coupler and said slider to each other, separate from the coupling of said coupler and said slider to each other by said first coupling structure, whereby complete release of said coupler and said slider from each other is affected by a first release step which comprises releasing the second stage coupling engagement, and subsequently a second release step which comprises releasing the first stage coupling engagement, the second release step comprising at least one of said slider and said coupler sliding along the length of such first and second elongate interlocking plastic rails.

28. Apparatus as in claim 27, said second coupling mechanism comprising a cover obstructing physical access to a release element on one of said coupler or said slider, which release element can, when not so obstructed, be activated to release the first stage coupling of said coupler and said slider to each other by said first coupling mechanism, while accommodating visual access to a top of at least one of said slider body and said coupler body through an aperture through said cover.

29. A package comprising apparatus as in claim 27.

30. A method of limiting access to a compartment of a package through a closure on such package, such closure having first and second elongate interlocking plastic rails, the package having mounted thereon apparatus for limiting access to the compartment through the closure, the access limiting apparatus comprising a slider, having a slider body, and comprising a slider channel adapted to interface with the first and second elongate interlocking plastic rails, the slider being adapted to being moved back and forth along lengths of the elongate interlocking plastic rails whereby interaction between the slider channel and the elongate interlocking plastic rails opens and closes the portions of the elongate interlocking plastic rails over which the slider is moved, a coupler, having a coupler body, said coupler body comprising a second slider channel adapted to interface with the first and second elongate interlocking plastic rails, and to being moved back and forth along the lengths of the elongate interlocking plastic rails, and a two-stage coupling mechanism configured to releasably couple the coupler and the slider to each other on the package, the two-stage coupling mechanism comprising a first coupling structure comprising first and second cooperating elements of the coupler and the slider, moveable into a first stage coupling engagement wherein any movements of the slider body and the coupler body only require linear movements, wherein the first and second cooperating elements engage with each other, thereby coupling the coupler and the slider to each other, and a second coupling structure comprising third and fourth cooperating elements of the coupler and the slider, each of the third and fourth cooperating elements being distinct from the first and second cooperating elements, the third cooperating element being moveable into a second stage coupling engagement with the fourth cooperating element, wherein the third and fourth cooperating elements engage with each other, thereby providing a second stage coupling of the coupler and the slider to each other, separate from the coupling of the coupler and the slider to each other by the first coupling structure, whereby complete release of the coupler and the slider from each other is affected by a first release step which comprises releasing the second stage coupling engagement, and subsequently a second release step which comprises releasing the first stage coupling engagement, the second release step comprising at least one of the slider and the coupler sliding along the length of the closure, the method comprising (a) moving the first and second cooperating elements into a first stage coupling engagement;

(b) after moving the first and second cooperating elements into the first stage coupling engagement, moving the third and fourth cooperating elements into a second stage coupling engagement; and (c) after moving the third and fourth cooperating elements into the second stage coupling engagement, effecting complete release of the coupler and the slider from each other by (i) as a first release step, releasing the second stage coupling engagement, and (ii) subsequent to the first release step of releasing the second stage coupling engagement, a second release step comprising releasing the first stage coupling engagement, the second release step comprising the slider sliding along the length of the closure.

* * * * *